US006301842B1

(12) United States Patent
Chaney et al.

(10) Patent No.: US 6,301,842 B1
(45) Date of Patent: Oct. 16, 2001

(54) DECK ASSEMBLY

(75) Inventors: Michael T. Chaney, Middletown; Jonathan C. Hauberg, Beavercreek; Paul A. Siudzinski, Springboro, all of OH (US)

(73) Assignee: Dayton Technologies, L.L.C., Monroe, OH (US)

( * ) Notice: Subject to any disclaimer, the term of this patent is extended or adjusted under 35 U.S.C. 154(b) by 0 days.

(21) Appl. No.: 09/470,532

(22) Filed: Dec. 22, 1999

(51) Int. Cl.[7] ..... E04F 15/00

(52) U.S. Cl. ..... 52/177; 52/386; 52/384; 52/555; 52/DIG. 8; 52/650.3

(58) Field of Search ..... 52/386, 384, 506.01, 52/650.3, 480, 732.2, 732.1, DIG. 8, 555

(56) References Cited

U.S. PATENT DOCUMENTS

| | | | | |
|---|---|---|---|---|
| 712,308 | * | 10/1902 | Kane | 52/177 |
| 3,999,397 | * | 12/1976 | Albery | 52/620 |
| 4,078,515 | | 3/1978 | Svirklys . | |
| 4,498,267 | * | 2/1985 | Beck | 52/555 |
| 5,009,045 | * | 4/1991 | Yoder | 52/177 |
| 5,048,448 | * | 9/1991 | Yoder | 52/588 |
| 5,642,592 | * | 7/1997 | Andres | 52/177 |
| 5,647,184 | | 7/1997 | Davis . | |
| 6,112,479 | * | 9/2000 | Andres | 52/177 |
| 6,170,212 | * | 1/2001 | Suchyna et al. | 52/177 |

* cited by examiner

*Primary Examiner*—Beth A. Stephan
*Assistant Examiner*—Dennis L. Dorsey
(74) *Attorney, Agent, or Firm*—Jacox, Meckstroth & Jenkins

(57) ABSTRACT

Parallel spaced elongated deck planks are extruded of a rigid plastics material, and each plank includes opposite vertical side walls integrally connected by a generally flat top wall and a contoured bottom wall. The bottom wall of each plank is formed by coplanar bottom edge portions and a bottom center portion integrally connected by a pair of inverted U-shaped or semi-cylindrical portions defining parallel spaced downwardly facing semi-cylindrical cavities. Radially positioned and thinner internal reinforcement walls integrally connect the top wall to each semi-cylindrical bottom wall portion, and a vertical center wall integrally connects the top wall with the bottom wall center portion. Elongated aluminum carrier strips cover the wood supporting joists, and each carrier strip has outwardly and downwardly projecting opposite edge portions to direct water from the joists. A series of attachment strips are secured to each carrier strip, and each attachment strip has a metal base strip with a pair of upwardly projecting opposing plastic snap clips. The snap clips engage corresponding flanges projecting inwardly from the bottom wall edge portions of each plank. A cross score line is formed in each base strip between each pair of snap clips which are bonded to the metal base strip along with pads of resilient plastics material located under the bottom wall edge and center portions of each plank.

16 Claims, 2 Drawing Sheets

DECK ASSEMBLY

BACKGROUND OF THE INVENTION

This invention relates to an extruded plastic deck structures or assemblies, for example, of the general type disclosed in U.S. Pat. Nos. 5,048,448, 5,642,592 and 5,647,184. In such deck assemblies, elongated deck planks are extruded of a generally rigid plastics material such as polyvinylchloride (PVC) and are attached to supporting parallel spaced joists of a frame by various means such as by the extruded plastic clips disclosed in above U.S. Pat. No. 5,048,448. After the clips are attached to the supporting joists or frame 16, the extruded plastic deck planks 24 are flexed slightly so that the outwardly projecting bottom flanges hook under the flange engaging portions or ribs of the attachment clips.

The extruded plastic deck planks disclosed in U.S. Pat. No. 5,642,592 are attached to the supporting joists by either longitudinally extending snap connector strips or laterally extending snap connectors, both of which are extruded of plastics material and engage bottom flanges on the planks. In U.S. Pat. No. 5,647,184, each of the extruded plastic deck planks is provided with a longitudinally extending and laterally projecting attachment flange which interlocks with the adjacent deck plank along the length of the plank. In U.S. Pat. No. 4,078,515, extruded aluminum deck planks have downwardly projecting and longitudinally extending skirts or legs, and the side legs of each plank have inwardly projecting flanges or shoulders. One of the side legs flexes so that the corresponding shoulder clips onto horizontally extending protrusions or bars attached to the supporting frame or rail members.

SUMMARY OF THE INVENTION

The present invention is directed to an improved deck system or assembly which provides a strong and durable walking surface and is ideally suited for forming outdoor decks, boardwalks, boat docks, staircases and the like. The deck assembly of the invention may be easily and quickly installed and provides for positively fastening a plurality of parallel deck planks to a supporting frame or substructure such as parallel spaced joists. The deck system of the invention also eliminates the squeaks and noises which are commonly generated by commercially available deck systems using deck planks of extruded plastics material such as PVC. The deck assembly of the invention may also be used to form park benches, stadium seats, bleachers, picnic tables, lawn furniture, boat docks and playground equipment, wherever a durable and corrosion resistant walking or seating surface is required. The deck planks of the invention are also adapted to receive supporting metal pipes or tubes, for example, when the deck planks are used to form seats for benches, boat docks, stadium bleachers or picnic tables.

In accordance with one embodiment of the invention, a deck assembly includes a plurality of parallel spaced deck planks each extruded of a rigid plastics material and having opposite longitudinal side walls integrally connected by a generally flat top wall and a contoured bottom wall. The bottom wall of each plank has coplanar bottom edge portions and a bottom center portion which are integrally connected by a pair of concave or semi-cylindrical wall portions spaced from the top wall and forming downwardly facing and longitudinally extending parallel spaced concaved cavities. Radially positioned internal reinforcing walls integrally connect the top wall to each semi-cylindrical bottom wall portions, and a vertical center wall integrally connects the top wall with the center portion of the bottom wall.

A series of plank attachment strips are secured to elongated carrier strips which cover and protect the supporting wood joists, and staples connect the attachment strips and carrier strips to the joists. Each attachment strip has a metal base strip with a pair of upwardly projecting opposing plastic snap clips for engaging corresponding flanges which project into the cavities from the bottom edge portions of each plank. A cross score line is formed in each metal base strip between each pair of snap clips, and the snap clips are bonded to the metal base strip along with pads of resilient plastics material which are located under the bottom wall portions of each plank.

Other features and advantages of the invention will be apparent from the following description, the accompanying drawings and the appended claims.

DESCRIPTION OF THE PREFERRED EMBODIMENT

Figure 1:
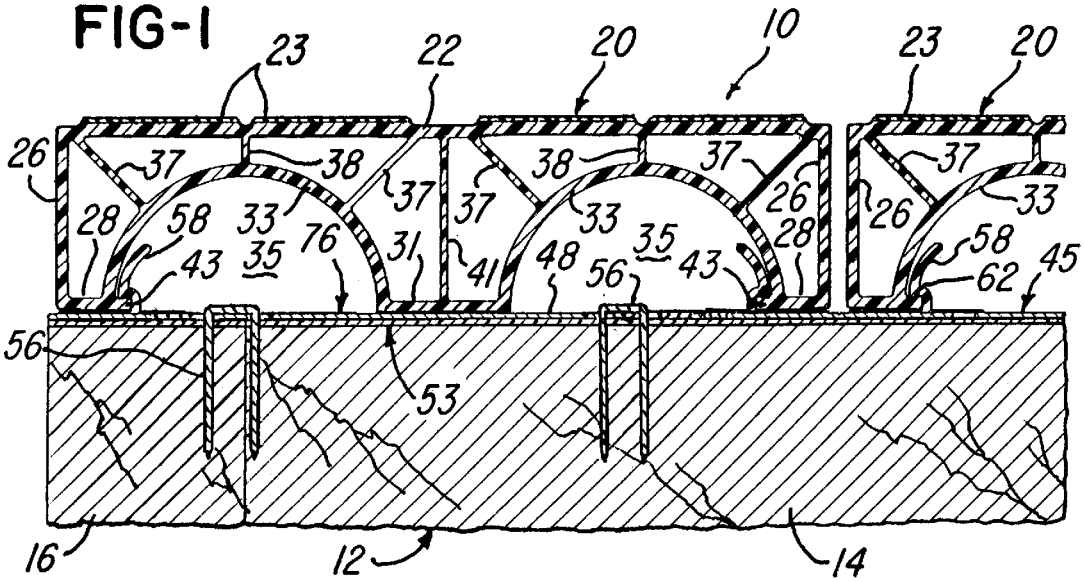
FIG. 1 is a fragmentary cross-section of a deck assembly constructed in accordance with the invention and illustrating its installation on one side portion of a supporting frame.

A deck assembly 10 is adapted to mount on a frame 12 which includes a plurality of parallel spaced joists 14 rigidly connected to peripheral frame members or joists 16. Commonly, the joists 14 and 16 are constructed of treated wood, but may also be constructed of other materials such as steel, aluminum or extruded polyvinylchloride (PVC). The deck assembly 10 includes a plurality of elongated deck planks 20 each of which is extruded of a rigid plastics material such as PVC. Each plank 20 has a top wall 22 with a raised surface 23 having a predetermined pattern to provide traction when the plank is used as a walking surface. The top pattern surface 23 may be formed from a thin co-extrusion of virgin PVC if the material for the remaining portion of the plank 20 includes a less expensive reground plastics material or PVC.

The top wall 22 of each plank integrally connects opposite vertical side walls 26 which are also integrally connected by a contoured bottom wall having flat co-planar edge portions 28 and a center portion 31. The bottom wall of each plank 20 also includes inverted U-shaped or concave wall portions 33 which integrally connect the flat bottom wall portions 28 and 31 and have an arcuate or semi-cylindrical cross-sectional configuration to define two parallel spaced and downwardly facing semi-cylindrical cavities 35.

The top wall 22, side walls 26 and bottom wall portions 28, 31 and 33 of each plank 20 all have substantially the same uniform thickness, and the top wall 22 is integrally connected to the arcuate bottom wall portions 33 by thinner reinforcement walls 37 and 38 which extend generally radially with respect to the arcuate or concave wall portions 33. A thinner vertical reinforcement wall 41 also integrally connects the top wall 22 of each plank 20 with the bottom wall center portion 31 so that each plank 20 has substantial rigidity and support strength and does not flex in a lateral direction.

Figure 3:
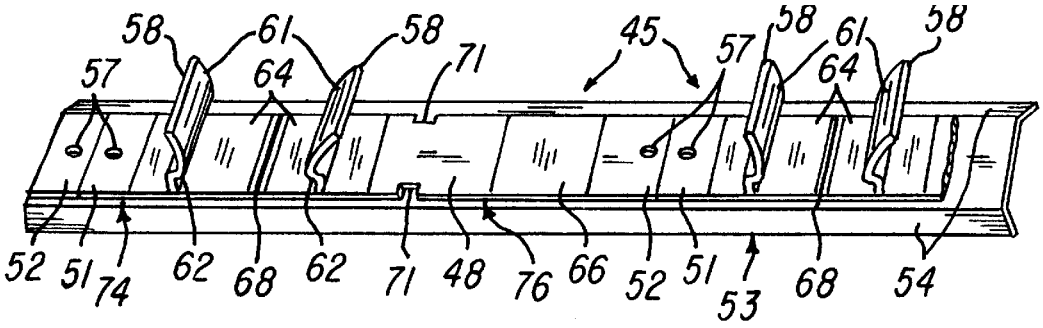
FIG. 3 is a perspective view of two attachment strips secured to a carrier strip in accordance with the invention and which are shown in cross-section in FIGS. 1 & 2.

A rib or flange 43 is integrally formed with each bottom wall edge portion 28 of each plank 20 and projects inwardly into the adjacent cavity 35. The flanges 43 are used for attaching each plank 20 to the supporting frame 12 by means of a series of attachment strips 45 (FIG. 3). Each attachment strip 45 includes a metal base strip 48, preferably formed of aluminum and having a length of about six inches. Each base strip 48 has an end portion 51 which is adjacent or abuts the opposite end portion 52 of the base strip 48 of another attachment strip 45, as shown in FIG. 3. Swaged-together button locks (not shown) secure the end portions of the base strips to an elongated aluminum carrier strip 53 having a length of several feet. The width of each attachment strip 45 is preferably the same as the width of the supporting joists 14 and 16, which is commonly 1⅜ inches, and the opposite edge portions 54 of each carrier strip 53 project outwardly and downwardly from the strips 45. The attachment strips and carrier strips 45 are secured to the joists 14 and 16 by a series of fasteners or staples 56 having legs which extend downwardly through clearance holes 57 in the end portions of adjacent strips 45 and in the carrier strips 53.

Each of the attachment strips 45 includes a pair of opposing spring-like snap clips 58 which are formed or molded of a flexible plastics material such as flexible PVC and are positively bonded or secured to the corresponding metal base strip 48. Each of the snap clips 58 has a cam or curved surface 61 which extends to a narrow lip or shoulder 62 spaced above the base strip 48 by a distance substantially equal to the thickness of the attachment flanges 43 on each plank 20. The metal base strip 48 of each attachment strip 45 also carries thin layers or pads 64 and 66 of resilient flexible plastics material such as flexible PVC, and the pads 64 are located on the metal base strip 48 between the clips 58.

A cross score line 68 is formed within each metal base strip 48 between the corresponding attachment clips 58 and pads 64 and in the underlying carrier strip 53 to permit convenient breaking of each attachment strip 45 and carrier strip 53 along the score line 68. A pair of alignment notches 71 are formed within the edge portions of the metal base strip 48 of each attachment strip 45 to facilitate lateral alignment of the attachment strips 45 on the parallel spaced joists 14 so that the attachment clips 58 are in lateral alignment across all of the joists 14 which form the frame 12.

Figure 2:
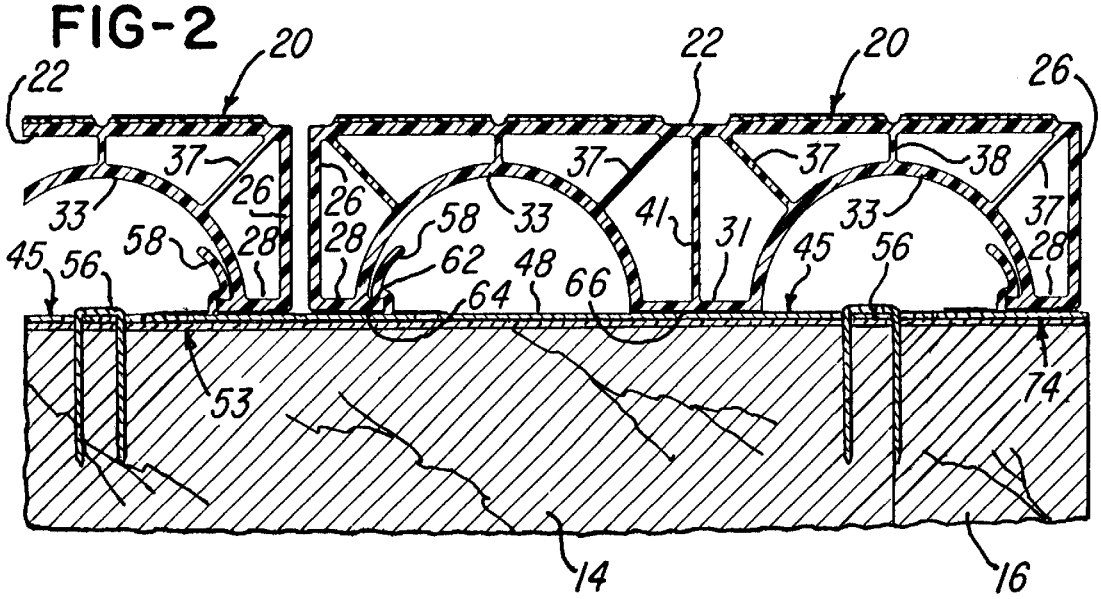
FIG. 2 is a fragmentary cross-section similar to FIG. 1 and illustrating the installation of the deck assembly on the opposite side portion of the supporting frame.

As apparent from FIGS. 1 and 2, one of the attachment strips 45 is broken along the score line 68 to form a starter attachment strip 74 (FIG. 2) having a single plastic clip 58 and a final end attachment strip 76 (FIG. 1) also having a single plastic clip 58. After the starter strip 74 is attached to each joist 16 followed by the attachment strips 45 and the end attachment strip 76, as shown in FIGS. 1 and 2, the planks 20 are then pressed downwardly against the attachment clips 58 so that the lips or flanges 43 engage the cam surfaces 61 of the attachment clips 58. The clips 58 flex sufficiently until the flanges 43 snap under the shoulders 62, and the bottom wall portions 28 and 31 of each plank seat on the resilient plastic layers or pads 64 and 66, respectively. The clips 58 form a positive connection of the planks 20 to the joists 14 and 16 of the frame 12 and also produce precision spacing between adjacent planks 20, as shown in FIGS. 1 and 2, as well as provide for linear expansion and contraction of each plank.

Figure 4:
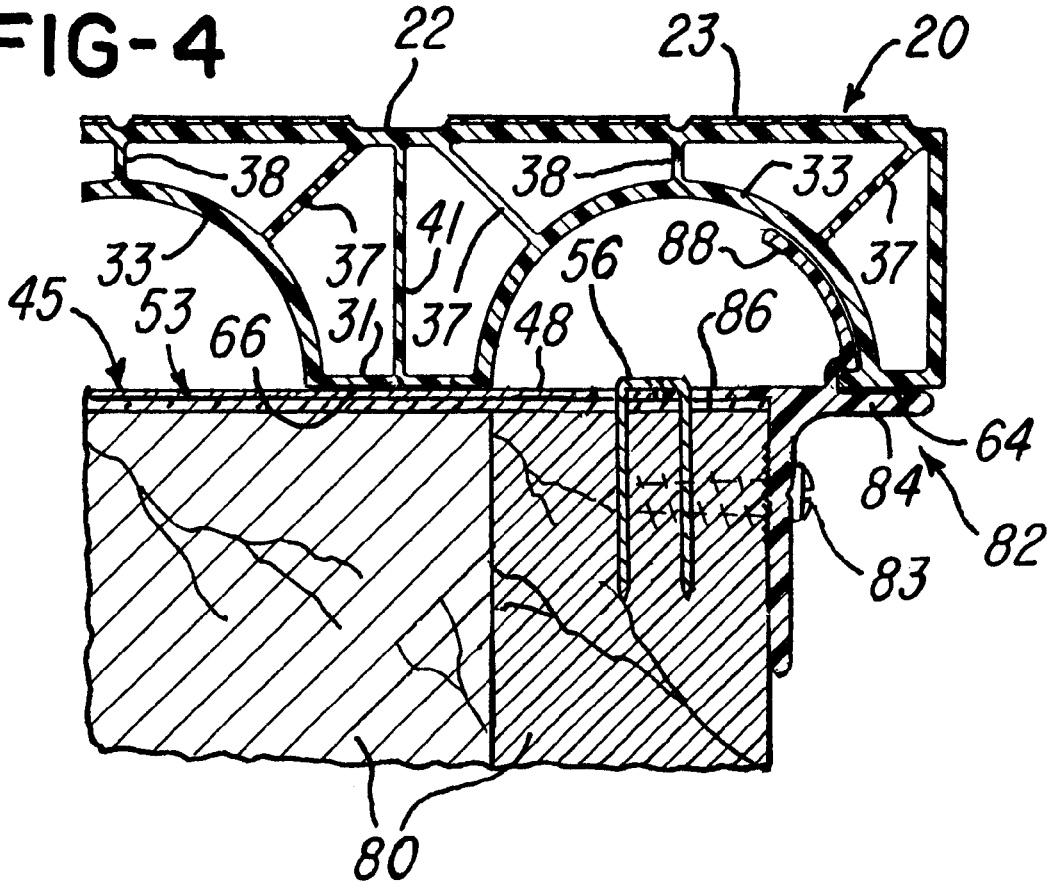
FIG. 4 is a fragmentary cross-section of a deck assembly and showing its installation to form a tread for a step.

Referring to FIG. 4, the elongated planks 20 may also be used to form the treads on a series of steps defined by supporting frame members or joists 80. For this application, a step attachment strip 82 is preferably extruded of a substantially rigid plastics material or PVC and includes a right angle nose portion 84, a flange 86 and a clip 88 having the same cross-sectional configuration as a clip 58 described above. The flange 86 of the strip 82 is attached to the frame member or joist 80 across the width of each step by means of longitudinally spaced fasteners or staples 56 and screws 83. The nose portion 84 of the strip 82 supports a projecting bottom wall edge portion 28 of a plank 20 which is secured to the attachment strip 82 by the elongated clip 88. The attachment strip 82 provides a positive and high strength cantilevered support for the projecting edge portion of the plank 20 (FIG. 4), which is desirable for the treads of a stairway.

From the drawings and the above description, it is apparent that a deck assembly constructed in accordance with the present invention, provides desirable features and advantages. For example, the cross-sectional configuration of the deck planks 20 provides for substantial rigidity and strength as well as a durable walking surface. The planks 20 may also be supported by parallel spaced metal or rigid plastic tubes, for example, when it is desired to use the planks 20 to form a seat or bench. The attachment strips 45 and carrier strips 53 also provide for a simple and positive means for fastening the planks to the supporting frame or joists and also provide for rapid installation of the deck planks 20 with a minimum of custom modifications in the field. Also, the wings or edge portions 54 of the carrier strips 53 provide for diverting water from the top surfaces of the wood joists and thereby extend the life of the joists. The pads 64 and 66 of resilient and flexible plastics material or PVC on the metal strips 48 also eliminate the squeaks and noises which are commonly generated when a deck plank of rigid PVC directly engages another supporting component of rigid PVC. In addition, the step attachment strip 82 provides a simplified means for quickly attaching the planks 20 to form a series of steps for a stairway.

While the form of deck system or assembly herein described constitutes a preferred embodiment of the invention, it is to be understood that the invention is not limited to this precise form of assembly, and that changes may be made therein without departing from the scope and spirit of the invention as defined in the appended claims.

What is claimed is:

1. A deck assembly comprising a plurality of elongated deck planks of substantially rigid plastics material, each of said planks including a longitudinally extending top wall integrally connecting longitudinally extending opposite side walls, said side walls connected to corresponding longitudinally extending and substantially coplanar bottom edge portions, longitudinally extending attachment flanges projecting from said bottom edge portions, a plurality of elongated attachment strips attached to a carrier strip to form a row of said attachment strips and adapted to be secured to a joist supporting said planks, said attachment strips extending transversely under said planks and including upwardly projecting clips positioned to engage said attachment flanges for securing said bottom edge portions of said planks to the supporting joists, and said carrier strip covers the joist to protect the joist.

2. A deck assembly as defined in claim 1 wherein said carrier strip has longitudinally extending opposite edge portions projecting downwardly and laterally outwardly from a flat center portion for diverting rain water from the joist.

3. A deck assembly as defined in claim 1 wherein adjacent said attachment strips on said carrier strip have adjacent end portions with a set of spaced holes, adapted to receive a staple for securing said attachment strips and said carrier strip to the joist.

4. A deck assembly comprising a plurality of elongated deck planks of substantially rigid plastics material, each of said planks including a longitudinally extending top wall integrally connecting longitudinally extending opposite side walls, a bottom wall integrally connecting said side walls and having longitudinally extending and substantially coplanar bottom outer edge portions and a longitudinally extending bottom center portion integrally connected by inverted U-shaped portions below said top wall, said U-shaped portions defining downwardly facing longitudinally extending parallel cavities, internal reinforcement walls integrally connecting said top wall of each said plank with the corresponding said U-shaped portions of said bottom wall, longitudinally extending attachment flanges projecting inwardly into said cavities from the corresponding said bottom outer edge portions, a plurality of attachment strips adapted to be secured to joists supporting said planks, said attachment strips extending transversely under said bottom edge portions of adjacent said planks, and each of said attachment strips including a pair of upwardly projecting and opposing snap clips positioned to clip said attachment flanges of adjacent said planks in response to engagement of said flanges for securing said bottom outer edge portions of said planks to the supporting joists and for precisely spacing adjacent said planks.

5. A deck assembly as defined in claim 4 wherein each of said inverted U-shaped portions of said bottom wall of each said plank has an arch-shaped cross-sectional configuration, and said internal reinforcement walls extend generally radially upwardly from each said U-shaped portion to said top wall.

6. A deck assembly as defined in claim 4 wherein said inverted U-shaped portions of said bottom wall of each said plank are each generally semi-cylindrical in cross-sectional configuration.

7. A deck assembly as defined in claim 4 wherein each said attachment strip comprises a weakened score line extending across said base strip between said pair of snap clips to facilitate separating said attachment strip into a starter attachment strip and a final end attachment strip each having one of said snap clips.

8. A deck assembly as defined in claim 4 wherein each said attachment strip comprises an elongated metal base strip, and each of said snap clips comprises a clip of plastics material bonded to said metal base strip and having a cam surface extending to a shoulder opposing said base strip.

9. A deck assembly as defined in claim 4 wherein said internal reinforcement walls of each said plank comprise a substantially vertical wall between a set of inclined converging walls integrally connecting said top wall to each of said inverted U-shaped portions of said bottom wall.

10. A deck assembly as defined in claim 4 and including an elongated carrier strip attached to a plurality of said attachment strips forming a continuous row, and adjacent said attachment strips having adjacent end portions with a set of spaced holes adapted to receive a staple for securing said attachment strips to the joists supporting said planks.

11. A deck assembly as defined in claim 10 wherein said carrier strip has longitudinally extending opposite edge portions projecting downwardly and laterally outwardly from a flat center portion for diverting rain water from the joist.

12. A deck plank adapted for use in a deck assembly, comprising an elongated plank body of substantially rigid plastics material, said plank body including a longitudinally extending top wall integrally connecting longitudinally extending opposite side walls, a bottom wall integrally connecting said side walls and having longitudinally extending and substantially coplanar bottom outer edge portions and a longitudinally extending bottom center portion integrally connected by two longitudinally extending and parallel spaced arch-shaped portions below said top wall, said arch-shaped portions defining downwardly facing and longitudinally extending parallel cavities, internal reinforcement walls integrally connecting said top wall of said plank with said arch-shaped portions of said bottom wall, and longitudinally extending and opposing attachment flanges projecting inwardly from said bottom outer edge portions into the corresponding said cavities for securing said bottom outer edge portions of said plank to a supporting frame.

13. A deck plank as defined in claim 12 wherein said arch-shaped portions of said bottom wall of said plank are each generally semi-cylindrical in cross-sectional configuration.

14. A deck plank as defined in claim 12 wherein said internal reinforcement walls of said plank comprise a substantially vertical center wall at the top of each said arch-shaped portion and a set of inclined converging walls integrally connecting said top wall to each of said arch-shaped portions of said bottom wall.

15. A deck plank as defined in claim 12 in combination with a T-shaped attachment strip adapted to be mounted on a frame for a stair tread, and said attachment strip includes an upwardly projecting snap clip engaging one of said attachment flanges on said deck plank.

16. A deck assembly comprising a plurality of elongated deck planks of substantially rigid plastics material, each of said planks including a longitudinally extending top wall integrally connecting longitudinally extending opposite side walls, a bottom wall integrally connecting said side walls and having substantially coplanar bottom edge portions and a bottom center portion integrally connected by inverted U-shaped portions below said top wall, said U-shaped portions defining downwardly facing longitudinally extending parallel cavities, internal reinforcement walls integrally connecting said top wall of each said plank with the corresponding said U-shaped portions of said bottom wall, longitudinally extending attachment flanges projecting inwardly into said cavities from said bottom edge portions, a plurality of elongated attachment strips adapted to be secured to joists supporting said planks, said attachment strips extending transversely under said planks and including upwardly projecting snap clips positioned to clip said attachment flanges in response to engagement of said flanges for securing said bottom edge portions of said planks to the supporting joists, each said attachment strip including a base strip with a pair of said snap clips in opposing relation, and a weakened score line extending across said base strip between said pair of snap clips to facilitate separating said attachment strip into a starter attachment strip and a final end attachment strip each having one of said snap clips.

* * * * *